US008464737B2

(12) United States Patent
La Chimia

(10) Patent No.: US 8,464,737 B2
(45) Date of Patent: Jun. 18, 2013

(54) STABILIZER SUPPORT FOR CRUTCHES AND/OR WALKING STICKS

(76) Inventor: Renato La Chimia, Florence (IT)

( * ) Notice: Subject to any disclaimer, the term of this patent is extended or adjusted under 35 U.S.C. 154(b) by 203 days.

(21) Appl. No.: 13/001,824

(22) PCT Filed: Apr. 16, 2009

(86) PCT No.: PCT/IT2009/000171

§ 371 (c)(1),
(2), (4) Date: Dec. 29, 2010

(87) PCT Pub. No.: WO2010/001426

PCT Pub. Date: Jan. 7, 2010

(65) Prior Publication Data

US 2011/0100404 A1 May 5, 2011

(30) Foreign Application Priority Data

Jun. 30, 2008 (IT) ..... FI20080038 U

(51) Int. Cl.
*A45B 3/00* (2006.01)
*A45B 9/04* (2006.01)

(52) U.S. Cl.
USPC ..... 135/66; 135/70; 135/80; 135/84; 248/171; 248/188.8

(58) Field of Classification Search
USPC ..... 135/65–66, 69–70, 77–78, 80–81, 135/84; 248/170–171, 159, 523, 528; 601/5, 601/23–24, 34–37; 211/123, 172, 196
See application file for complete search history.

(56) References Cited

U.S. PATENT DOCUMENTS

| | | | | |
|---|---|---|---|---|
| 651,649 | A * | 6/1900 | Brown | 280/300 |
| 721,425 | A * | 2/1903 | Olyde | 248/170 |
| 2,753,879 | A | 7/1956 | Rosen | |
| 3,524,456 | A * | 8/1970 | Dixon | 135/65 |
| 4,091,828 | A * | 5/1978 | Jorgensen | 135/66 |
| 4,915,332 | A | 4/1990 | Ouellette | |
| 4,947,882 | A * | 8/1990 | Levasseur | 135/84 |
| 6,192,908 | B1 * | 2/2001 | Smith | 135/66 |
| 6,527,001 | B1 * | 3/2003 | Saldan et al. | 135/82 |
| 6,612,320 | B2 * | 9/2003 | Lin et al. | 135/33.41 |
| 7,219,679 | B2 * | 5/2007 | Hsu et al. | 135/66 |
| 7,344,320 | B2 * | 3/2008 | Barker et al. | 396/419 |
| 2005/0056739 | A1 * | 3/2005 | Koning et al. | 248/171 |
| 2005/0205121 | A1 * | 9/2005 | Lindgren | 135/78 |

FOREIGN PATENT DOCUMENTS

| | | | |
|---|---|---|---|
| DE | 80 24 836 | U1 | 2/1981 |
| DE | 90 12 614 | U1 | 11/1990 |
| DE | 200 18 883 | U1 | 2/2001 |
| DE | 202 04 475 | U1 | 8/2002 |
| FR | 2 669 097 | A | 5/1992 |

* cited by examiner

*Primary Examiner* — Winnie Yip
(74) *Attorney, Agent, or Firm* — McGlew and Tuttle, P.C.

(57) ABSTRACT

Stabilizer support for crutches and/or walking sticks, comprising a cylindrical body (1) with vertical axis within which there is a seat destined to receive a portion of a crutch or walking stick (S). The stabilizer support comprises more extractable feet (5) which, in a retracted position, are vertical and are inside the said body (1) while, in the extracted position, are spread apart and are external to the said body (1) thus forming a stable base of the stabilizer support. Furthermore, the stabilizer support comprises a knob (6) through which a slide (4) is made to vertically move inside the said body (1), the said feet (5) being connected with the said slide (4).

12 Claims, 5 Drawing Sheets

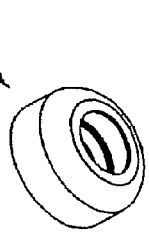
FIG.1
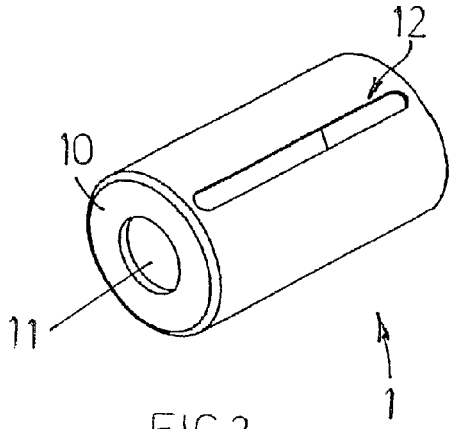
FIG.2
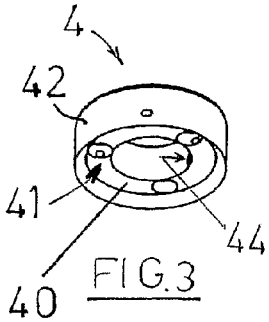
FIG.3
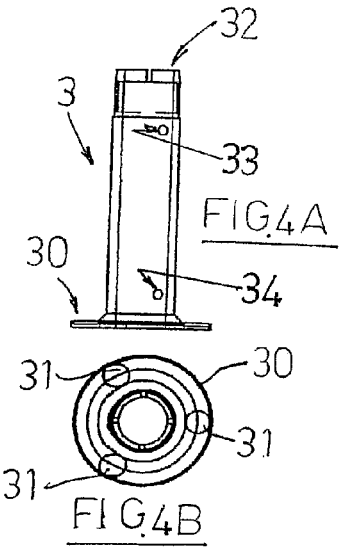
FIG.4A
FIG.4B
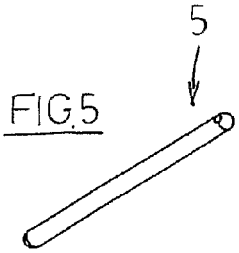
FIG.5
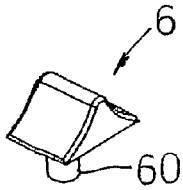
FIG.6

STABILIZER SUPPORT FOR CRUTCHES AND/OR WALKING STICKS

It is known that aids such as crutches and walking sticks for people with walking difficulties involve discomfort related to the inherent instability of the same, especially when not used. In fact, in order to prevent their fall, these items are often placed close to walls, chairs, tables and so on, in a standing inclined position, that is, in such a way that those who may pass near the crutches or walking sticks can stumble and fall.

The main purpose of the present invention is to eliminate the above-mentioned drawbacks.

This result has been reached, in accordance with the present invention, by adopting the idea of making a device having the characteristics indicated in claim 1. Other features of the present invention are the subject of the dependent claims.

A stabilizer support according to the present invention improves and simplifies the use of aids such as crutches and walking sticks, without interfering with their structural characteristics and without reducing their strength. In addition, a device in accordance with this invention is simple to be manufactured, inexpensive, reliable even after prolonged and repeated use, and requires no special maintenance operations that, however, are facilitated by the ease of disassembly of the device.

These and other advantages and features of the present invention will be more and better understood by any technician of this industrial field, thanks to the following description and to the attached drawings, provided by way of example but not to be considered in a limitative, wherein:

FIGS. 1-6 show the individual components of a stabilizer support for crutches and/or walking sticks in accordance with the present invention;

Figure 7:
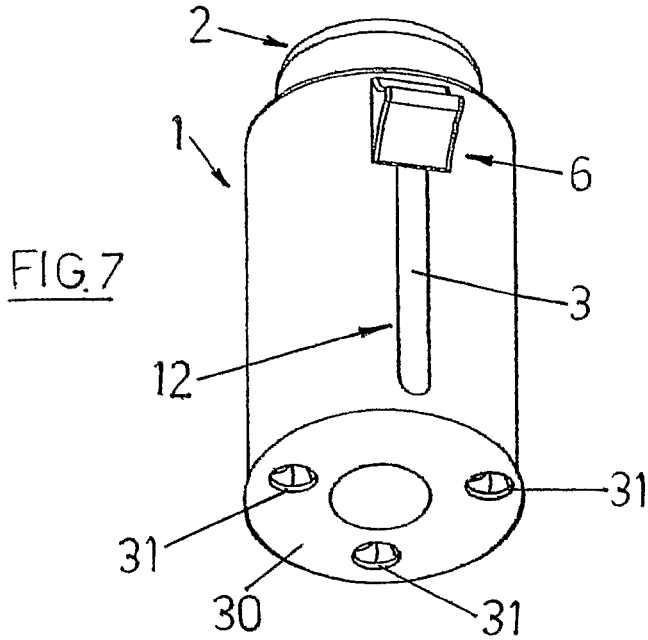
FIG. 7 is a perspective bottom view of a stabilizer support for crutches and/or walking sticks in accordance with the present invention in its inoperative state, i.e. with the feet (5) retracted.

In the following description the word "crutch" refers to sticks with antebrachial support.

Reduced to its essential structure and with reference to the figures of the attached drawings, a stabilizer support for crutches and walking sticks in accordance with the present invention comprises a cylindrical body (1) with vertical axis, in which the lower base is missing, and whose upper base (10) has a central hole (11) and the lateral surface has a longitudinal slit (12).

Over the upper base of the body (1) there is mounted an annular threaded ring (2), used to lock the crutch (S) to the stabilizer support, as further described below.

Inside the said body (1) there is positioned, coaxially, a tubular element (3) which has a lower discoid base (30) which, in turn, has three angularly equidistant holes (31) with vertical axis. The upper part (32) of the element(3) is threaded and protrudes over the upper base (10) of the body (1) passing through the said hole (11). The threaded ring (2) is screwed on the threaded part (32) of the tubular element(3).

On the tubular element (3) there is fitted a ring (4), which is free to slide along the same element (3), and which has a lower surface (40) where there are defined three hooking points (41) for the feet (5) indicated below and a lateral surface (42) that protrudes below the said lower surface (40), so that the lower edge of the surface (42) results below the surface (40).

The said ring (4) supports three feet (5) in angularly equidistant positions.

Figure 14:
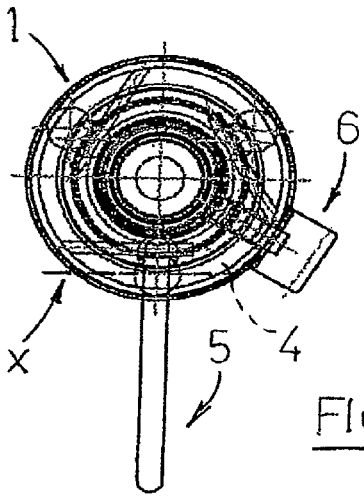
FIG. 14 is a view in cross-section of the device shown FIG. 9 and FIG. 10.

More specifically, each of the said feet (5)—which according to the example shown in the figures of the attached drawings are made by rods—is hinged to the bottom surface (40) of the ring(4) by means of a pin which constitutes a hinge with horizontal axis (axis "x" in FIG. 14) so that they can freely rotate both in the opening direction (direction outgoing from the sheet in the drawing of FIG. 14) and in the closing direction (direction entering the sheet in the drawing of FIG. 14).

A knob (6)is connected with the ring (4). The stem (60) of the said knob is screwed on the lateral surface (42) of the ring (4) and passes through the slot (12) of the body (1), so that the knob (6) is external to the body (1).

The knob (6) is used to manually control the sliding of the ring (4) along the tube (3) and, thus, the extraction or retraction of the feet (5). More precisely, starting from the configuration of FIG. 7 (knob 6 and ring 4 in the raised position), by lowering the knob (6) there is obtained the expulsion or extraction of the feet (5) which pass through the holes (31) of the base of the (3) and gradually diverge thanks to the said hinged connection with the ring (4) and to the fact that the lower edge of the surface (42) thereof is flared, forming a guide for the feet (5) during the feet extraction step. Conversely, starting from the configuration of FIG. 8 (knob 6 and ring 4 in the lowered position) by lifting the knob (6) there is obtained the retraction or return of the feet (5) which pass in the holes (31) and are progressively "closed", approaching the tubular element (3) and assuming, at the end of the raising step, a vertical position (in practice, during extraction and retraction of the feet 5, these open or close like the rods of an umbrella). During the retraction of the feet (5) the flaring of the lower edge of the lateral surface (42) of the ring (4) contributes to a more correct retraction of the same feet (5).

Figure 8:
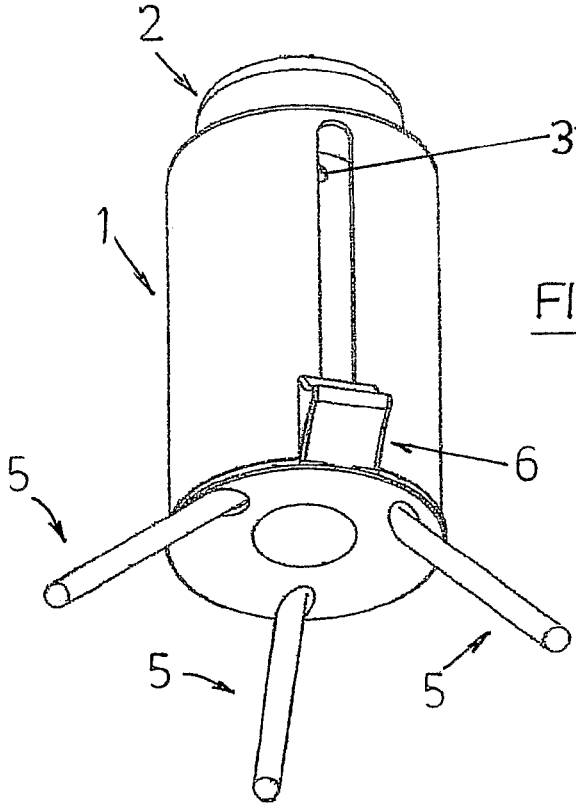
FIG. 8 represents the device of FIG. 7 with the feet (5) extracted.
Figure 9:
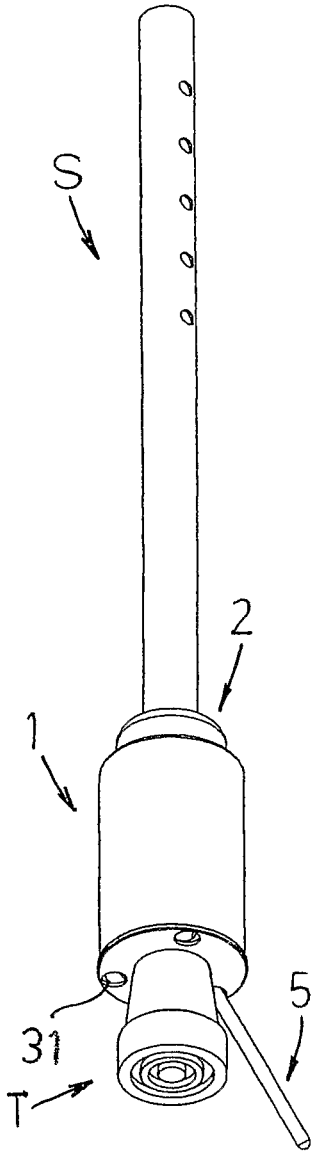
FIGS. 9 and 10 illustrate the device of FIG. 7 and FIG. 8 in its use, with only one foot (5) extracted to better illustrate other parts of the device.
Figure 10:
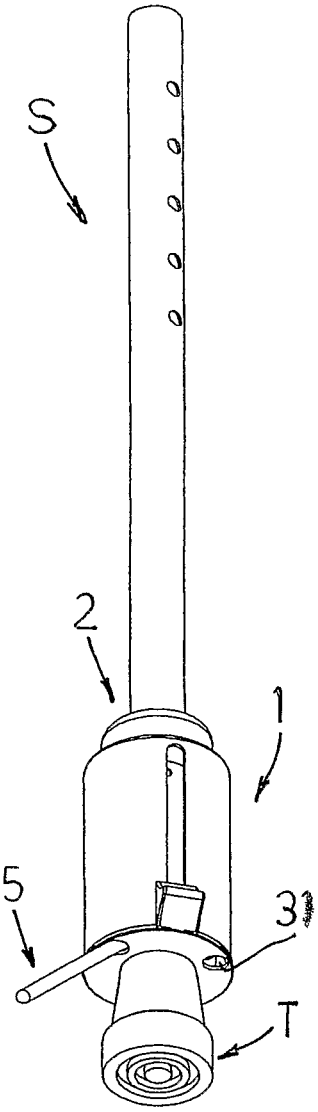
Figure 11:
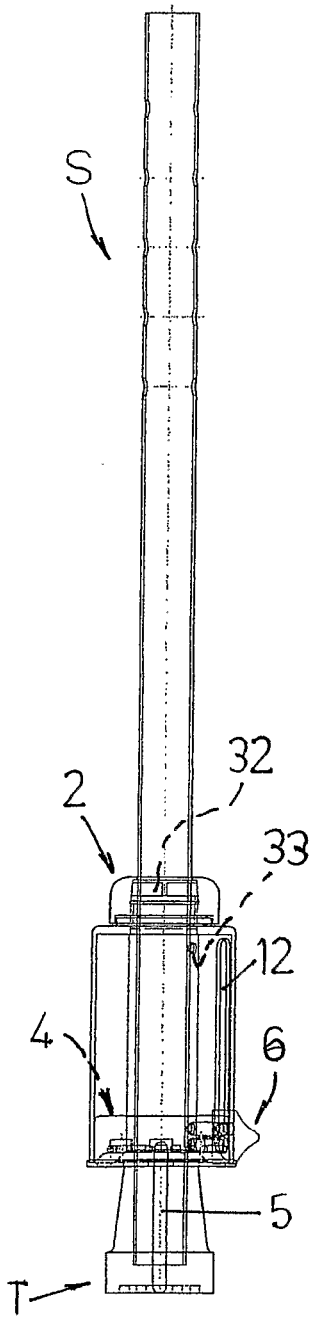
FIGS. 11 and 12 are two views in diametral section of the device shown in FIG. 9 and FIG. 10.
Figure 12:
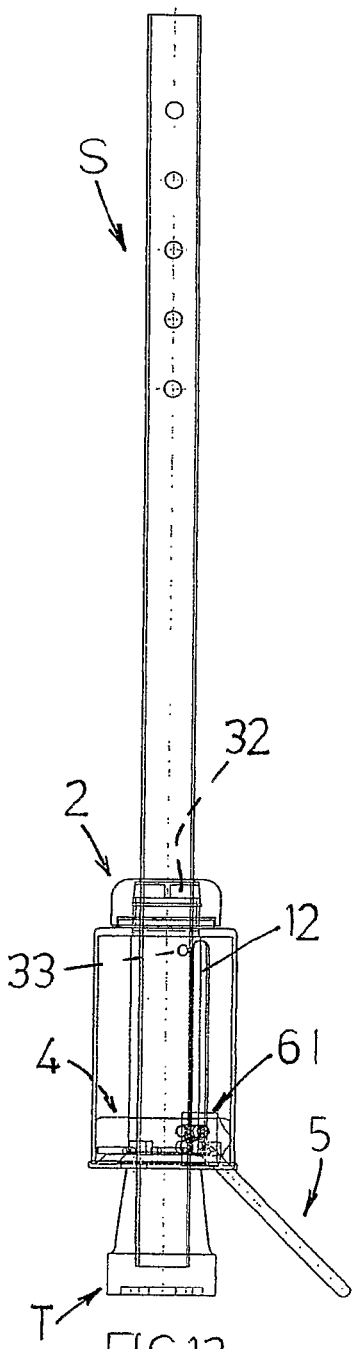
Figure 13:
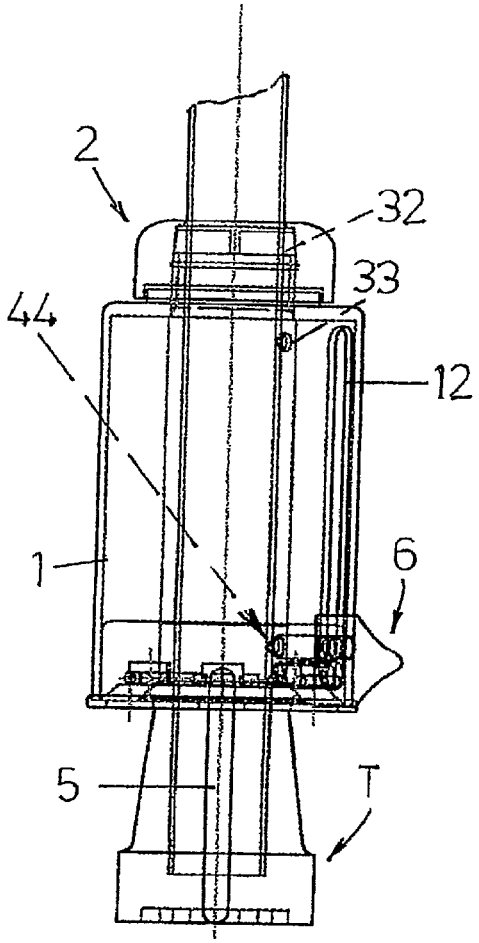
FIG. 13 represents an enlarged particular of the device shown in FIG. 12.

On the inner surface (43) of the ring (4) there is mounted a radial elastic plug (44) which serves to lock the ring (4) to the tube (3) in the positions of complete lifting (position FIG. 7) and of complete lowering (position of FIG. 8). To this end, the element (3) has two radial cavities (33, 34)—one radial cavity near its top base and the other adjacent to its lower base—in which cavities the front end of the plug (44) is engaged when the ring (4) is in the raised position (position of FIG. 7) or in the lowered position (position of FIG. 8). The said radial elastic plug (44) is pushed in the radial direction by a spring (not indicated in the drawings), so when the ring (4) is positioned in correspondence to the cavity (33) or cavity (34), the plug (44) is inserted therein, thus locking the ring (4) to the tube (3). The thrust exerted by the spring on the plug (44) does not prevent the sliding of the ring (4) on the tube (3) when the knob (6) is raised or lowered. In the passage of the ring (4) from the raised position to the position of FIG. 7 to the lowered position of FIG. 8 the front end of the elastic plug (44) just slides on the outer surface of the tube (3).

Therefore:

- the ring (4) and the feet (5) are external to the tube (3);
- the ring (4) is designed to vertically slide along the tubular element (3), that is, along the direction of the (vertical) axis of the body (1);

the group formed by the ring (4), the feet (5) and from the tube (3) is internal to the body (1), with the exception of the upper threaded portion (32) of the tube(3) which extends beyond the hole (11) of the upper body (1);

the plug (44) is positioned between the ring (4) and the tubular element (3);

the knob (6) is external to the body (1) and is connected with the ring (4);

the holes (31) on the discoid base (30) of the tube (3) contribute to guide the feet (5) during their return or retraction and extraction or expulsion.

To use the stabilizer support in accordance with the present invention, the threaded ring (2) is unscrewed, the cap (T) of the crutch (S) is removed and the crutch is inserted through the hole (11) of the body (1) and through the tube (3), from top to bottom, until the lower part of the crutch protrudes from the base (30). Then the said cap (T) is replaced on the crutch and the ring (2) is screwed on the threaded upper portion (32) of the tube (3) to lock the crutch (S) to the tube (3). Then, acting on the knob (6), the feet (5) are extracted, by lowering the ring (4) until the plug (44) engages the lower radial cavity (34) of the tube (3). At this point, the crutch (S) is locked to the support whose stability is ensured by the three feet (5) which, being spread apart, realize a stable base. To free the crutch (S) one will proceed in the reverse order.

It goes without saying that the length of the rods that form the feet (5) is such that the cap (T) of the crutch is raised, that is not in contact with the ground.

Needless to say, moreover, that the internal diameter of the tube (3) is a value that allows to set the stem of crutches or walking sticks (S) of standard size. For example, the components of the stabilizer support in accordance with the present invention can be of plastic material (such as material like "Derlin") or metal (like aluminium or steel) or carbon fiber.

In practice, the details of implementation may vary in any equivalent manner regarding the shape and size of individual elements described and illustrated, and the nature of the materials, without departing from the idea of solution adopted to obtain the above-mentioned advantages and therefore remaining within the limits of the protection afforded by this patent.

The invention claimed is:

1. A stabilizer support for crutches and/or walking sticks, comprising:

a tubular element for receiving a portion of a crutch or walking stick;

a cylindrical body with a vertical axis arranged around said tubular element;

extractable feet movable between a retracted position and an extracted position, said extractable feet being vertical and inside said cylindrical body in said retracted position, said extractable feet being spread apart and external to said cylindrical body in said extracted position to form a stable base of the stabilizer support; and a slide vertically movable inside said cylindrical body, said extractable feet being connected with said slide;

a knob connected to said slide and movable with said slide;

a radial elastic plug mounted on a surface of said slide for locking said slide to said tubular element, said tubular element having two radial cavities, one of said radial cavities being near a top portion of said tubular element and another one of said radial cavities being adjacent to a lower base of said tubular element, said radial cavities being engaged by the plug when the slide is in a raised or lowered position.

2. A stabilizer support according to claim 1, wherein said tubular element is internal and coaxial to said cylindrical body and said tubular element comprises a lower discoid base, said lower discoid base comprising three angularly equidistant holes with vertical axis and said lower discoid base forms the lower base of said cylindrical body.

3. A stabilizer support according to claim 2, wherein an upper base of said cylindrical body has a central hole arranged around said tubular element, an upper portion of said tubular element protrudes above the upper base of the cylindrical body.

4. A stabilizer support according to claim 2, wherein said slide consists of a ring free to slide along said tubular element.

5. A stabilizer support according to claim 1, wherein an upper base of said cylindrical body has a central hole arranged around said tubular element, an upper portion of said tubular element protrudes above the upper base of the cylindrical body.

6. A stabilizer support according to claim 5, wherein said upper portion of said tubular element is threaded and a threaded ring is screwed on said upper portion to lock the crutch or walking stick to said tubular element when using the stabilizer support.

7. A stabilizer support according to claim 1, wherein said cylindrical body has a longitudinal slit through which passes a stem, said stem connecting said knob to the slide.

8. A stabilizer support according to claim 1, wherein said slide consists of a ring free to slide along said tubular element.

9. A stabilizer support according to claim 1, wherein said extractable feet are made by rods, said extractable feet being three in number and said extractable feet are connected to the slide in angularly equidistant positions.

10. A stabilizer support for crutches and/or walking sticks, comprising:

a tubular element for receiving a portion of a crutch or walking stick;

a cylindrical body with a vertical axis arranged around said tubular element;

extractable feet movable between a retracted position and an extracted position, said extractable feet being vertical and inside said cylindrical body in said retracted position, said extractable feet being spread apart and external to said cylindrical body in said extracted position to form a stable base of the stabilizer support; and a slide vertically movable inside said cylindrical body, said extractable feet being connected with said slide;

a knob connected to said slide and movable with said slide;

said tubular element is internal and coaxial to said cylindrical body and said tubular element comprises a lower discoid base, said lower discoid base comprising three angularly equidistant holes with vertical axis and said lower discoid base forms the lower base of said cylindrical body;

an upper base of said cylindrical body has a central hole arranged around said tubular element, an upper portion of said tubular element protrudes above the upper base of the cylindrical body.

11. A stabilizer support according to claim 10, wherein a radial elastic plug is mounted on a surface of said slide for locking said slide to said tubular element, said tubular element having two radial cavities, one of said radial cavities being near a top portion of said tubular element and another one of said radial cavities being adjacent to a lower base of said tubular element, said radial cavities being engaged by the plug when the slide is in a raised or lowered position.

12. A stabilizer support for crutches and/or walking sticks, comprising:

a tubular element for receiving a portion of a crutch or walking stick;

a cylindrical body with a vertical axis arranged around said tubular element;

extractable feet movable between a retracted position and an extracted position, said extractable feet being vertical and inside said cylindrical body in said retracted position, said extractable feet being spread apart and external to said cylindrical body in said extracted position to form a stable base of the stabilizer support; and a slide vertically movable inside said cylindrical body, said extractable feet being connected with said slide;

a knob connected to said slide and movable with said slide;

said tubular element is internal and coaxial to said cylindrical body and said tubular element comprises a lower discoid base, said lower discoid base comprising three angularly equidistant holes with vertical axis and said lower discoid base forms the lower base of said cylindrical body;

a radial elastic plug mounted on a surface of said slide for locking said slide to said tubular element, said tubular element having two radial cavities, one of said radial cavities being near a top portion of said tubular element and another one of said radial cavities being adjacent to a lower base of said tubular element, said radial cavities being engaged by the plug when the slide is in a raised or lowered position.

* * * * *